United States Patent [19]

Graninger

[11] 3,959,614

[45] May 25, 1976

[54] LIMIT SWITCH ROTARY RETURN MECHANISM

[75] Inventor: Frank J. Graninger, Milwaukee, Wis.

[73] Assignee: Allen-Bradley Company, Milwaukee, Wis.

[22] Filed: Oct. 7, 1974

[21] Appl. No.: 512,237

[52] U.S. Cl. ..... 200/47; 200/153 K

[51] Int. Cl.[2] ..... H01H 19/18

[58] Field of Search ..... 200/47, 153 K, 153 V, 200/153 SC, 153 L, 153 LA, 153 LB; 74/107

[56] References Cited

UNITED STATES PATENTS

| | | | |
|---|---|---|---|
| 2,927,988 | 3/1960 | Powell | 200/153 V |
| 3,512,422 | 5/1970 | Aslan | 74/107 |
| 3,749,860 | 7/1973 | Crepeau | 200/47 |

*Primary Examiner*—Gene Z. Rubinson
*Assistant Examiner*—M. Ginsburg
*Attorney, Agent, or Firm*—Quarles & Brady

[57] ABSTRACT

An electrical limit switch has a rotary camshaft provided in an operating head which is mounted upon a main switch body which houses electrical switch contacts. Rotational input motion of the camshaft is translated into a linear output motion of an actuator for operating the switch contacts. A minor return spring acts in series with a major return spring upon a flat formed in the camshaft to center the camshaft in a neutral position. The minor return spring is compressed as the camshaft is initially rotated to enable a low torque operation of the shaft until after actuation of the switch contacts, while the major return spring is compressed after switch actuation to provide a principal return force for the camshaft upon its rotary deviation from the neutral position. A spring stop element is inserted between the major and minor springs to limit compression of the minor return spring following an operation of the switch contacts.

10 Claims, 6 Drawing Figures

LIMIT SWITCH ROTARY RETURN MECHANISM

BACKGROUND OF THE INVENTION

The invention relates to a return mechanism for an electrical limit switch, and more particularly to a return mechanism which enables low torque switch actuation and provides adequate return force for the actuator of the electrical limit switch.

Electrical limit switches are widely utilized for precise control and position indication in applications with machine tools, conveyors, transfer machines, and other types of modern high-speed production equipment. These devices are characterized by an enclosed body housing electrical switch contacts which are actuated by a movement imparted to an operating shaft protruding from the body. The operating shaft may be rotatable about its axis, or, alternatively, translatable along its axis and generally includes a biasing arrangement for returning the shaft to a neutral condition.

A particular species of limit switch constructions is that of the oil tight design, so called because this switch normally includes some type of seal for preventing oil, greases and related contaminants from entering into the area of the electrical switch contacts. In the oil tight limit switch, there is a main switch body sheltering the switch contacts upon which is mounted a smaller enclosure known as an operating head. An operating shaft is journaled within the head, inside of which there is means for converting shaft displacement into actuation of the associated switch contacts. In sequential control applications, it is often preferable to effect a momentary operation of these switch contacts followed by an automatic resetting of the limit switch. For this reason, it becomes necessary to provide a spring return mechanism within the operating head in order to force the operating shaft to a zero or neutral position.

Prior limit switches reflective of this general structure and behavior are disclosed in U.S. Pat. No. 3,373,257 issued to L. H. Matthias et al. on Mar. 12, 1968, and U.S. Pat. No. 3,749,860 issued to R. G. Crepeau on July 31, 1973. In these devices, an operating shaft protruding from an operating head is rotated to impart a vertical reciprocating motion to a plunger member which causes actuation of switch contacts located in a switch body below the head. A single compression spring acts upon a seat formed in the rotary operating shaft and serves to urge the shaft to a normal position upon its rotary displacement from such position.

Another related limit switch design is shown in U.S. Pat. No. 3,546,954 to M. D. Ustin. In this construction, twin compression springs of equal force are arranged in parallel to urge an operating shaft to a neutral position after being rotated to operate switch contacts in a body. This arrangement is similar to Matthias and Crepeau in the concept of utilizing some type of spring force mainly for resetting a limit switch.

While such return mechanisms are generally satisfactory in restoring the initial position of a rotary operating shaft of a limit switch, they often require an undesirably high operating torque for actuating the associated switch contacts. This is especially detrimental to the overall behavior of a machine in many light control applications. For example, a limit switch is often used as a pilot device to regulate conveyor operations, in which application an external lever mounted on the operating shaft of the switch is subjected to a wide range of stimuli imparted by moving components on the conveyor. When a conveyor component contacts the external lever to rotate the operating shaft, this mechanical movement opens or closes electrical switch contacts housed within the switch so as to stop the movement of the conveyor. Once physical engagement of the component against the external lever has been removed, the operating shaft will return to a neutral position under the influence of a spring return mechanism, and the limit switch will be reset for continued conveyor monitoring. In many cases, small loads being transported upon a conveyor are insufficient to overcome the biasing force supplied by the spring return mechanism. As a result, these small loads do not actuate the switch and are instead deflected away from the external lever of the limit switch. The small loads are many times pushed off the conveyor and damaged beyond repair.

Some switch constructions employed in the art have been designated to provide low torque operation but only when coupled with a minimum of return force. An example of such a switch is disclosed in U.S. Pat. No. 3,317,687 to W. F. Dehn issued May 2, 1967. In this device, a relatively light spring force bears against a flat surface of an operating camshaft urging the camshaft to a zero position. Upon application of an external force, the light spring allows for a low force rotation of the camshaft such that switch actuation may easily occur. With the release of the external force, the light spring weakly returns the camshaft to its initial position but has insufficient force to reset the switch without manual assistance.

Heretofore, prior art designs have incorporated equalized biasing mechanisms chiefly for purposes of restoring rotary actuators and switch mechanisms to a reset position, or enabling low torque operation of rotary actuators while sacrificing a loss in return force. The present invention is intended to improve upon these prior operating characteristics.

SUMMARY OF THE INVENTION

The present invention relates to a return mechanism for a switch actuating device having a rotary camshaft engageable with movable actuator for operating switch contacts, and it more specifically resides in a major return spring acting serially with a minor return spring upon a flat formed in the camshaft to center the camshaft in a neutral position.

In the preferred form of the invention, an external force is applied to initially rotate the operating camshaft of a limit switch away from the neutral position causing a vertical, reciprocating motion of the actuator towards a switch actuating position. Until switch actuation occurs, only the minor return spring is principally compressed so that a low operating torque can actuate the switch contacts. After the camshaft reaches the switch actuating position, stop means prohibit further compression of the minor return spring, and the major return spring is then serially compressed throughout an over-travel path of the camshaft. Upon release of the external applied force, the energy stored in the compressed major and minor return springs is expended to restore the switch to a reset condition and effect full return of the camshaft to the neutral position.

Utilization of the present invention is particularly advantageous in optimizing low actuation torque, adequate return force and sufficient overtravel for the rotary camshaft of the limit switch. The dual spring arrangement disclosed herein contemplates a relatively large spring force acting in serial cooperation with a comparatively small spring force upon a rotary actuating member to provide a switch which is not only automatically and fully reset for cyclical applications, but also uniquely sensitive to weak stimuli for improving machine control.

It is a general objective of the invention to provide a biasing mechanism for a rotary camshaft of a limit switch which enables low torque operation of the camshaft until switch actuation occurs and supplies adequate return force for restoring the camshaft to a neutral position.

Another objective is to provide an extended arcuate travel of a rotary camshaft used in a limit switch without a loss in return force. This feature permits a generous overtravel mode for the camshaft beyond a switch actuation thereby eliminating the possibility of strain or breakage of the camshaft.

A further object is to provide a rotary return mechanism which is easily incorporated into existing limit switch structures without extensive switch revision.

It is still another object to provide a limit switch in which the maximum operating torque required for actuation is minimized.

The foregoing and other objects and advantages of the invention will appear from the following description. In the description reference is made to the accompanying drawings which form a part hereof, and in which there is shown by way of illustration and not of limitation a preferred embodiment of the invention. Such embodiment does not represent the full scope of the invention, but rather the invention may be employed in many different embodiments, and reference is made to the claims for interpreting the breadth of the invention.

DESCRIPTION OF THE PREFERRED EMBODIMENT

Figure 1:
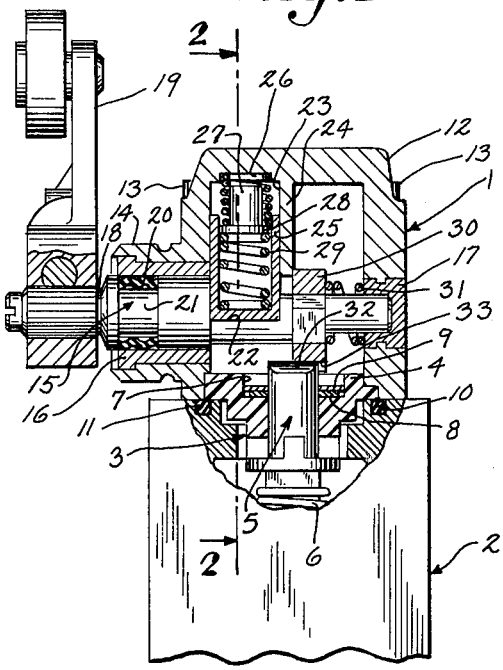
FIG. 1 is a fragmentary, side view in cross section of an electrical limit switch incorporating a rotary return mechanism embodying the present invention.

Referring to the drawings, the return mechanism of this invention may be employed in conjunction with an operating head of a limit switch such as the type shown and described in U.S. Pat. No. 3,749,860, issued July 31, 1973 to Robert G. Crepeau for "Sealed Limit Switch." Only those elements necessary for an understanding of the present invention will be described, and attention is drawn to U.S. Pat. No. 3,749,860 for a more detailed description of the switch operating head.

Figure 2:
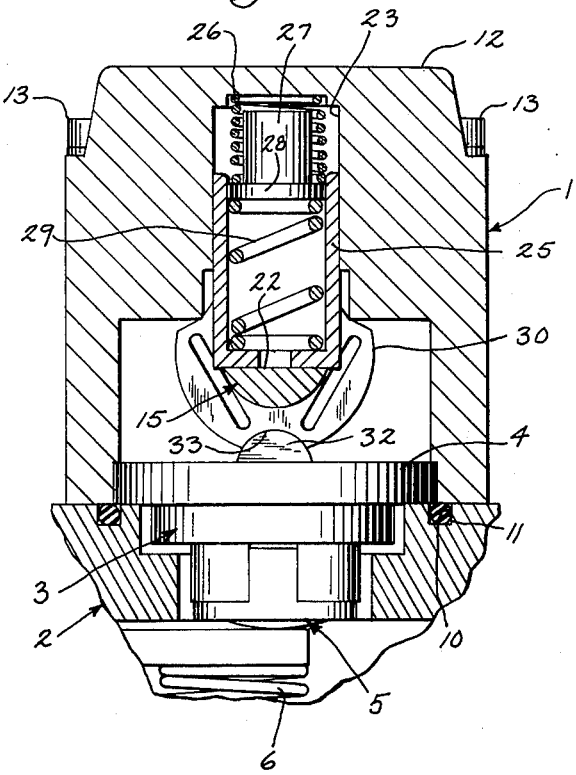
FIG. 2 is a fragmentary view on an enlarged scale and in cross section taken in the plane 2—2 shown in FIG. 1, FIGS. 3–5 are schematic diagrams illustrating various operational positions of a rotary camshaft of the limit switch.

In FIGS. 1 and 2, there is shown a limit switch having a hollow operating head 1 with an open bottom that rests upon and closes over a stepped opening formed in a main switch body 2. A generally circular intermediary member 3 has a collar 4 which lies in the bottom of the operating head 1 and radially overlaps the opening of the switch body 2 to define a partition between the upper head 1 and the lower switch body 2. A linearly movable actuator 5 extends through a central passageway provided in the intermediary member 3 and operates against a switch spring 6 for actuating a switch contact mechanism located within the interior cavity of the body 2. The contact mechanism is of the snap action type disclosed in U.S. Pat. No. 3,769,474, issued to J. A. Deubel et al. on Oct. 30, 1973, and reference should be made thereto for the detailed description of the contact mechanism. Generally, the contact mechanism utilizes leaf springs and toggle springs to provide a snap-action closing of contacts following a lost motion in the actuator 5. At times the leaf and toggle springs add to the force of the switch 6 and at other times they subtract therefrom. The top surface of the collar 4 is formed with a circular recess 7 for the reception of a felt washer 8 and a retaining ring 9, both of which encircle the actuator 5 to create a seal between the intermediary member 3 and the actuator 5. A circular groove 10 is provided within the top surface of the body 2 to seat an O-ring 11 which seals the intermediary member 3 and the operating head 1 with the body 2 into an oil tight unit.

The operating head 1 has a rectangular side wall configuration provided with a frusto-conical roof 12, and is secured to the body 2 in any one of four angular positions by a set of four mounting bolts 13. A hub 14 projects from the front of the head 1 and includes a throughbore leading from the exterior to the hollow interior of the head 1. A movable operating camshaft 15 is journaled in a bushing 16 secured within the hub 14, and the rear end of the camshaft 15 is journaled in a bearing 17 in a side of the head 1 directly opposite the hub 14. The camshaft 15 protrudes horizontally from the hub 14 and has a front end 18 on which an operating lever 19 may be fixed so that a stimulus applied to the end of the lever 19 will correspondingly rotate the camshaft 15. A sealing sleeve 20 surrounds a recessed portion 21 of the camshaft 15 within the bushing 16 and serves as an oil tight collar to prevent lubricants from emigrating from the head 1.

The camshaft 15 has an intermediate section which is milled to form a flat 22 upon which acts a biasing return mechanism embodying the present invention. The flat 22 is formed beyond the axis of rotation of the camshaft 15 so that the flat 22 can act as a cam surface eccentric to the axis of rotation. A return pocket 23 provided in the interior of the head 1 lies directly above the location of the flat 22, and includes a rear guiding wall 24. A return plunger 25 is slidably disposed for vertical movement within the pocket 23, and bears against the camshaft flat 22. A minor return compression spring 26 is seated at its top in a circular recess formed in the roof of the pocket 23 and encircles a spindled stop element 27 having an enlarged circular base 28 which rides within the plunger 25. A major return compression spring 29 is disposed within the plunger 25 beneath the circular base 28 of the stop element 27. The minor and major return springs 26 and 29 are partially compressed in the assembled position to urge the plunger 25 downwardly against the flat 22 so that the camshaft 15 is centered in a neutral or zero position, as shown in FIG. 2. The engagement of the plunger 25 with the flat 22 also holds the camshaft axially within the head 1.

Rearwardly of the flat 22, the camshaft 15 is keyed to receive a lobed cam 30. A cam spring 31 interposed between the cam 30 and the bearing 17 urges the camshaft 15 outwardly against the restraint of the plunger 25. The linearly movable actuator 5 is biased upwardly by the resulting forces of the switch spring 6 and the biasing and toggle springs of the switch mechanism so that the convex apex 32 of the actuator is urged to seat in an arcuate groove 33 formed in the cam 30. It is the function of the return mechanism of this invention to return the cam 30 to the neutral position in which the apex 32 of the actuator 5 seats in the groove 33 whenever the external actuating stimulus is removed from the lever 19. The manner in which this is accomplished will now be described by reference to the schematic illustrations of FIGS. 3–5.

Figure 3:
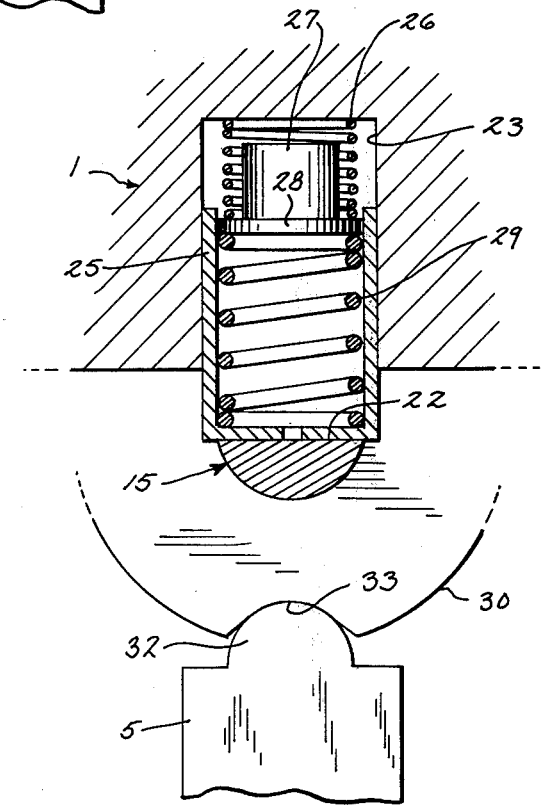

In the absence of an applied force against the lever 19, the minor and major return springs 26 and 29 are slightly compressed and urge the return plunger 25 downwardly against the flat 22 so that the apex 32 of the actuator 5 maintains its engagement within the arcuate groove 33 of the cam 30 (see FIG. 3).

Figure 4:
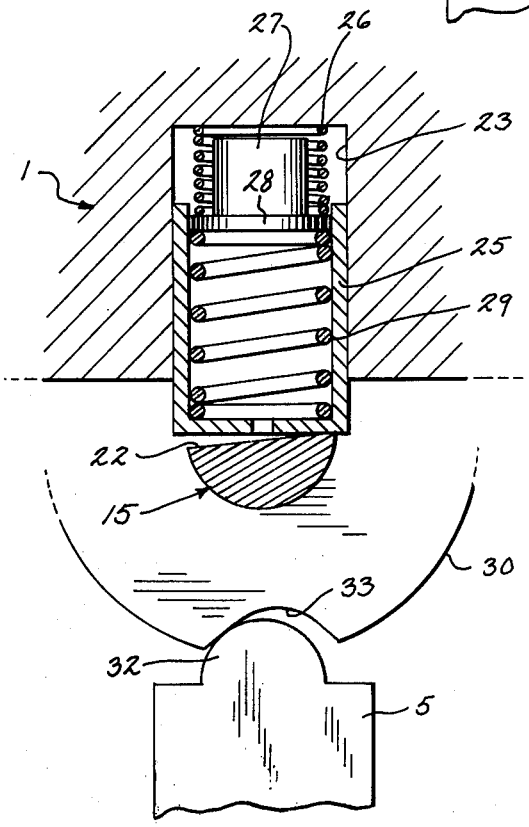

Assuming now that a stimulus is applied to the lever 19 such that the camshaft 15 is rotated in a counterclockwise direction, an edge of the flat 22 will engage the underside of the plunger 25 forcing the plunger upwardly. At the same time, the actuator 5 will be forced downwardly as its apex 32 is forced out of mating engagement with the groove 33 in the cam. As the plunger 25 is forced upwardly, the minor spring 26 will be compressed since it is a significantly lighter spring than the major spring 29. This action is illustrated in FIG. 4. The cam 30 and its groove 33 are so dimensioned that sufficient linear motion is applied to the actuator 5 to actuate the associated switch contacts before the apex 32 is forced completely out of the groove 33. Similarly, switch actuation will occur before the minor spring 26 is compressed to the point at which the stop element 27 contacts the roof of the pocket 23 and prevents further compression of the minor spring 26. Thus, to actuate the switch contacts, the stimulus applied to the lever 19 need overcome only the relatively light force imparted by the minor return spring 26 in addition to the forces imparted by the switch spring 6 and contact mechanism. Although the compression force of the minor spring 26 is additive to those forces exerted by the switch spring 6 and the contact mechanism, it is of relatively light magnitude to insure that a low torque applied to the camshaft 15 will be sufficient to accomplish switch actuation. Such behavior is ideally adapted for use in control situations in which the external triggering stimulus is slight. If the stimulus is removed before the actuator 5 clears the groove 33, the minor return spring 26 should exert sufficient force to turn the camshaft 15 back to the neutral position.

Figure 5:
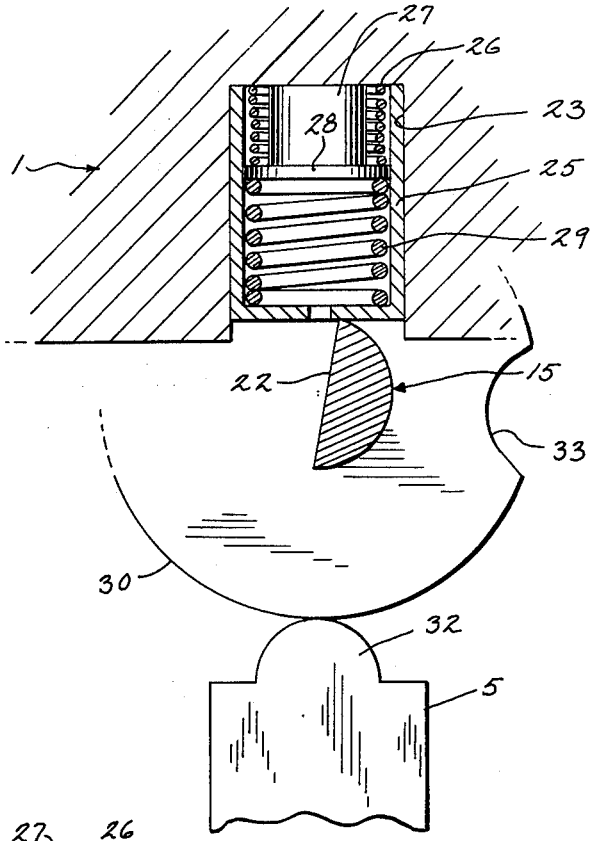

Turning to FIG. 5, if the stimulus is continued to be applied to the lever 19 after the apex 32 of the actuator 5 passes out of the groove 33, the camshaft 15 will assume an overtravel mode during which the apex 32 of the actuator 5 rides upon a lobed surface of the cam 30 and switch actuation is maintained. Since the stop element 27 will engage the roof of the pocket 23 at about the time that the apex 32 leaves the groove 33, a continuing stimulus applied to the lever 19 allows the camshaft 15 to be rotated against the force of the major return spring 29 which is then compressed between the stop element 27 and the plunger 25. When the plunger 25 abuts the roof of the pocket 23, the limit of rotation of the camshaft 15 and lever 19 is reached. In the preferred embodiment, the camshaft 15 is rotatable up to a range of 75°–86° from neutral. This generous overriding movement eliminates the possibility of strain or breakage of the components in the head 1 which might otherwise occur because of rough operation or erratic stimuli applied to the camshaft 15.

Upon the subsequent release of the stimulus on the lever 19, the compression of the major return spring 29 provides a relatively large force acting against one edge of the flat 22 which effectively returns the cam 30 in a clockwise direction. The apex 32 of the actuator 5 rides back along the lobe of the cam 30 towards the groove 33 into which the apex 32 is urged upwardly by the switch spring 6. Final centering of the camshaft 15 and the cam 30 is made possible by the additional release of energy stored in the compressed minor spring 26. Hence, the camshaft 15 is restored to its initial orientation with the plunger 25 seated across the surface of the flat 22, and the limit switch is automatically reset as the apex 32 of the actuator 5 again seats in the groove 33.

Throughout the above described operation, it has been assumed that the camshaft 15 and the cam 30 have been rotationally displaced by a stimulus applied to the lever 19 in a counterclockwise direction. It should be appreciated, however, that the spring return mechanism operates in a similar manner when a clockwise stimulus is applied to the lever 19.

Figure 6:
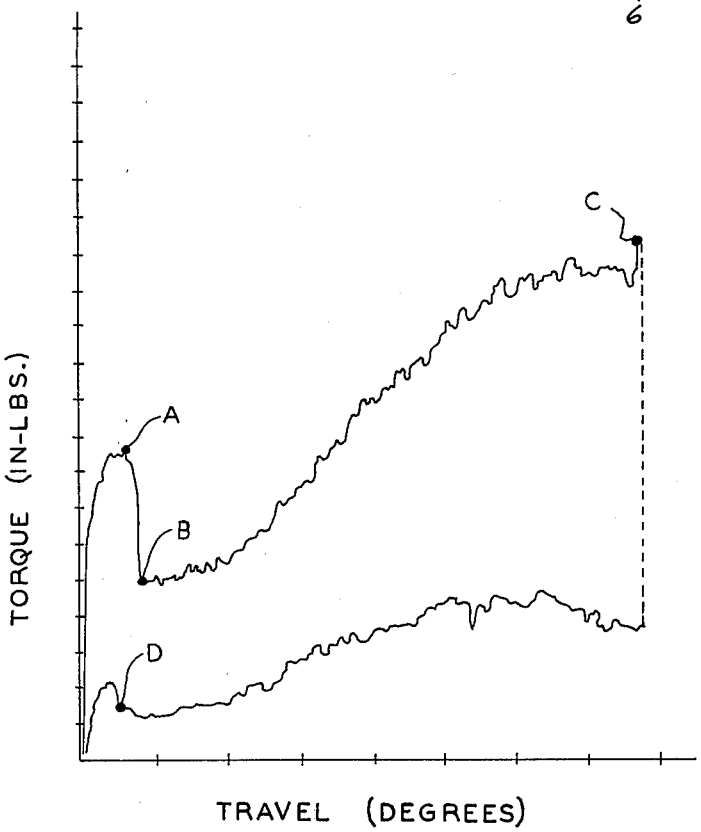
FIG. 6 is a graphical representation of torque versus arcuate travel of the rotary camshaft.

The relation of the operational and return torques to a full rotary travel of the camshaft 15 provided with the return mechanism of the present invention is graphically portrayed in FIG. 6. In FIG. 6, the upper portion of the curve of the graph represents the torque required to rotate the camshaft 15, while the lower curve indicates the torque applied to the camshaft 15 after removal of the stimulus. As the camshaft 15 is first rotated from the neutral position of FIG. 3 toward the actuated position of FIG. 4, the torque required to rotate the camshaft 15 increases until a peak is reached at point A. This increase in torque reflects the composite behavior of the compression of the switch spring 6, the aligning of toggle springs in the contact mechanism, and the compression of the minor return spring 26. The maximum operating torque required to actuate the switch is represented by point A and this magnitude is held to a minimum value due to the relatively light force required to compress the minor return spring 26. When the switch is actuated at or slightly after point A, the snap-over mechanism in the contact mechanism will act in opposition to the switch spring 6 so that the operating torque required to move the actuator 5 falls rapidly until the point B is reached.

When the apex 32 of the actuator 5 subsequently clears the groove 33 and comes into engagement with the lobed surface of the cam 30, further rotation of the camshaft 15 compresses the major return spring 29 and the operating torque increases as the amount of compression of the major spring 29 increases, since further compression of the minor return spring 26 is prohibited by the engagement of the stop element 27 against the roof of the pocket 23. When the point C is reached, the operating torque is at a maximum and the limit of rotation is reached by the plunger 25 abutting the roof of the pocket 23.

Upon removal of the stimulus, the major return spring 29 of the return mechanism facilitates a complete reset of the switch and, together with the minor return spring 26, accomplishes a full independent return of the camshaft 15 to a neutral position. As can be seen in the lower curve of the graph of FIG. 6, the potential energy stored in the major return spring 29 is released to move the camshaft 15 back towards neutral to reset the switch. Such reset is accompanied by a small jump in return torque which is caused by the additive force of the contact mechanism after the contacts have been reset. This small jump occurs at point D. Final return of the camshaft 15 to its neutral position and the actuator 5 within the groove 33 is aided by the release of energy stored in the minor return spring 26 as well as the unloading of the switch spring 6.

Provision of the major return spring 29 permits a generous overtravel movement of the camshaft 15, in addition to supplying a sufficient return force for automatically resetting the switch and repositioning the camshaft 15. Referring to FIG. 5, it can be seen that if a large overtravel is provided, the return force to be exerted on the camshaft 15 must be large because the reaction force at the point of contact between the edge of the flat 22 and the return plunger 25 will act through a small moment arm about the axis of the camshaft 15. In prior art mechanisms which used a single return spring, large overtravel could be achieved only by use of a large force spring which necessarily required that the actuation force would be great to overcome the single large spring force. With the present invention, a large spring force can be provided by way of the major return spring 29 without affecting the switch actuating force since the major return spring 29 plays an insignificant role in determining switch actuation force. Futhermore, an acutating mechanism incorporating this invention can be tailored to a customer's requirement for overtravel. That is, the major return spring 29 could be selected to produce the necessary return force for a given required degree of overtravel with weaker springs being satisfactory as the amount of overtravel is reduced.

The serialized dual spring return mechanism is compact and economical, and may easily be incorporated within existing operating head structures with a minimum of modification whenever it is desirable to combine low torque operation with complete automatic switch reset.

In a measurement of torque of a camshaft in a switch embodying the return mechanism constituting the present invention, the operating torque to actuate the switch was found to be 0.87 in.-lbs. The operating torque at the overtravel limit was 1.3 in.-lbs. and the return torque at reset was recorded at 0.22 in.-lbs.

I claim:

1. In a switch actuating mechanism having a linearly movable switch actuator for operating associated switch contacts, a switch spring operating against said linearly movable switch actuator, a rotary camshaft having an engagement with said linearly movable switch actuator to impart linear motion thereto in response to rotation of the camshaft, such camshaft having a flat against which a return spring force operates to center the camshaft in a neutral position, the combination of means including:

a major return spring having a relatively large spring force acting upon said camshaft flat urging said camshaft to said neutral position upon compression thereof;

a minor return spring having a relatively small spring force acting serially with said major return spring upon said camshaft flat also urging said camshaft to said neutral position upon compression thereof; and stop means limiting compression of said minor return spring upon rotation of said camshaft away from said neutral position.

2. A switch actuating mechanism as in claim 1, in which said stop means prohibits further compression of said minor return spring after a switch operation of said associated switch contacts.

3. A switch actuating mechanism as in claim 2, wherein at least a portion of said stop means lies intermediate said major and minor return springs.

4. A switch actuating mechanism as in claim 3, together with a linearly movable return plunger resting upon said camshaft flat, and wherein said major and minor return springs and said stop means are guidingly disposed in vertical alignment within said plunger.

5. A switch actuating mechanism as in claim 4 including an operating head provided with a return pocket within which said linearly movable return plunger slides upon rotation of said camshaft away from said neutral position.

6. A switch actuating mechanism as in claim 5, wherein said linearly movable return plunger is engageable with a top portion of said operating head upon rotation of said camshaft away from said neutral position thereby limiting further compression of said major return spring and rotation of said camshaft away from said neutral position.

7. A switch actuating mechanism as in claim 6, wherein said minor return spring is engageable with said top portion of said operating head and said stop means bottoms against said top portion of said operating head after a switch operation of said associated switch contacts.

8. A switch actuating mechanism as in claim 7, wherein said minor return spring is compressible until a switch operation of said associated switch contacts occurs.

9. A switch actuating mechanism as in claim 8, wherein said major return spring is principally compressible after a switch operation of said associated switch contacts occurs.

10. In a switch actuating mechanism having a linearly movable switch actuator for operating associated switch contacts, a switch spring operating against said linearly movable switch actuator, a rotary camshaft having an engagement with said linearly movable switch actuator to impart linear motion thereto in response to rotation of the camshaft, such camshaft having a flat against which a return spring force operates to center the camshaft in a neutral position, the combination of means including:

a major return spring having a relatively large spring force acting upon said camshaft flat and urging said camshaft to said neutral position upon compression thereof;

a minor return spring having a relatively small spring force acting serially with said major return spring upon said camshaft flat and also urging said camshaft to said neutral position upon compression thereof;

stop means having at least a portion intermediate said major and minor return springs and adapted to limit compression of said minor return spring upon rotation of said camshaft away from said neutral position and following actuation of said switch contacts; and a return plunger resting upon said camshaft flat and having said major and minor return springs and said stop means guidingly disposed therein.

* * * * *